US006478172B2

(12) United States Patent
Zingerman

(10) Patent No.: US 6,478,172 B2
(45) Date of Patent: Nov. 12, 2002

(54) PORTABLE LIFTING DEVICE

(76) Inventor: David Zingerman, 1615 Wilcox Ave., Los Angeles, CA (US) 90068

( * ) Notice: Subject to any disclaimer, the term of this patent is extended or adjusted under 35 U.S.C. 154(b) by 3 days.

(21) Appl. No.: 09/754,601

(22) Filed: Jan. 4, 2001

(65) Prior Publication Data

US 2002/0084238 A1 Jul. 4, 2002

(51) Int. Cl.[7] ..... B66C 23/22
(52) U.S. Cl. ..... 212/179; 212/324
(58) Field of Search ..... 212/179, 324; 104/126

(56) References Cited

U.S. PATENT DOCUMENTS 1,646,133 A * 10/1927 Bechman et al. ..... 212/179 X
4,068,827 A * 1/1978 Fanning et al. ..... 212/179 X
4,266,904 A 5/1981 Fadness
6,065,621 A 5/2000 Fatemi et al.

FOREIGN PATENT DOCUMENTS

| | | | | |
|---|---|---|---|---|
| DE | 3806599 | * | 9/1989 | ..... 212/179 |
| FR | 2659073 | * | 9/1991 | ..... 212/324 |
| RU | 1604722 | * | 11/1990 | ..... 212/179 |
| RU | 1772073 | * | 10/1992 | ..... 212/179 |
| RU | 2128621 | * | 4/1999 | |

* cited by examiner

*Primary Examiner*—Steven A. Bratlie

(57) ABSTRACT

A portable lifting device provides the heavy and massive object lifting, loading and/or unloading through the window opening and includes a plurality of telescopic stanchions, each of which comprises at least two of a plurality of telescopic sections, a frame, comprising brackets connected to triangular trusses, connected by the adjustable holders to the telescopic stanchions, a girder with the installed trolley, a grip, a winch with an electrical motor, and a hook unit.

1 Claim, 2 Drawing Sheets

PORTABLE LIFTING DEVICE

FIELD OF THE INVENTION

This invention relates to the portable lifting devices intended to lift the massive objects and mostly for the massive object lifting and loading and/or unloading through the window openings.

BACKGROUND OF TIE INVENTION

The devices for lifting of the objects and transporting them for short distances have become specialized.

Some of such devices are characterized by having a central bay defined by two spaced sides and an arch-like structure connecting the sides that bridges over the bay. A straddle carrier is adapted to be driven over a load, such as a container or van, to receive the load within the bay. By raising the load is elevated for transport, or for stacking one container upon another by utilizing the frame as an elevator. In some straddle carriers the bay is sufficiently large so that by turning the load can be shifted in its orientation, and it is consequently desirable to suspend the load in such fashion that they can turn or reorient the load without moving the entire straddle carrier.

It is unsatisfactory to maneuver the entire straddle carrier in order to align the spreader frame with the load, and the art has addressed itself to this problem by providing some controlled degree of longitudinal and lateral movement of the spreader frame with respect to the straddle carrier chassis. For example, some spreader frames are supported by four hoist cables connected to its four corners, and one end of the frame can be shifted either sidewardly, or turned so as to skew the entire frame.

The U.S. Pat. No. 4,266,904 discloses a lifting device with the spreader frame. The frame is swivelly connected to a vertically adjustable reaction member that is fixed against rotation but free to pivot sidewardly, an extendible operating element connected between the frame and the reaction member for swivelling the frame with respect to the reaction member about a first axis of movement, a second extendible operating element connected between the frame and the reaction member for swivelling the frame with respect to the reaction member about a second axis of movement, a third extendible operating member for pivoting the reaction member, and supporting elements spaced along the frame adapted to raise and lower the frame. Alignment of the frame can then be made with a load that is oriented initially at a substantial variance in position from the frame in either the horizontal or vertical direction. Further, once the load is raised it can be reoriented in its position by swivelling the frame, or translating the frame in any of several directions of movement without any necessity of maneuvering the straddle carrier from which it is suspended. In this manner, a load can, for example, be lifted from a freight car that is positioned in one direction, then rotated through an arc and translated to another position for depositing on a semi-trailer that is positioned in a different direction than the freight car. With this capability the associated straddle carrier, or other structure that suspends the spreader frame, need not be moved in trans-shipping a load from one form of conveyance to another. Furthermore, the spreader frame makes practical a form of straddle carrier spanning a large open area between its ground engaging supports, or which cantilevers a frame outwardly from its supports to also service a working area outside the perimeter of the supports. It then becomes possible to use a straddle carrier as a form of gantry, as well as being a vehicle for transporting a load from one site to another. The elongated spreader frame is suspended beneath a trolley that can move back and forth along rails. A vertically adjustable reaction member in the form of a column extends from the trolley downward to a swivel connection with the spreader frame. The column is mounted in the trolley in a restricted manner that restrains it from rotation, but it is free to pivot in the longitudinal direction of the spreader frame. A pair of hydraulic operating cylinders are connected between the column and the spreader frame for swivelling the spreader frame around two axes of movement. The spreader frame is also supported from the trolley near its ends by lifting means that can raise and lower the frame ends with respect to the trolley. The entire frame can then be raised or lowered, or by independent movement of the lifting means the frame can be tilted about a third axis. Thus, the spreader frame can be rotated about any of three principal axes to spatially orient it through a substantial range of positions. Shifting movements which translate the spreader frame are also made possible. One shifting movement is accomplished by connecting a hydraulic cylinder between the column and the trolley to tilt the column and thereby shift the swivel connection at the lower end of the column in the longitudinal direction of the frame.

nThe mentioned prior art is complex and does not provide the lifting, loading and/or unloading the objects through the window opening.

Another U.S. Pat. No. 6,065,621 discloses the lifting mechanism, having a telescopic boom, four telescopic support legs with pivotable wheels thereon, and a low center of gravity frame of a two part construction pivotally connected together and having a tilt indicator warning thereon.

Specifically the lifting mechanism includes the first frame, a second frame, a pair of rear retractable and extendible leg extensions (or wheel frames), a rear wheels and on each rear wheel frame, a pair of front retractable and extendible outriggers (wheel frames), a front wheels on each front wheel frame, a selectively retractable and extendible boom, a boom angle actuator, an actuator drive device in communication with the boom angle actuator such as by electrical or fluid lines, a power supply in communication with the selected parts of the lift mechanism that need power, a winch with a controller thereon and in communication with the power supply such as by electrical lines, a snatch block, a tilt indicator, a safety switch or switches, a remote winch control or switch box, and a remote actuator control or switch box. The first and second frames have a lot of additional components (such as legs or main axle, pivot arms, etc.) respectively to each other.

This lifting mechanism is complex and massive.

Thus, there is a great need in the art for portable lifting devices to lift the objects (on the assigned high level), for example, such as construction materials, machinery equipment through window opening into the building under construction, and/or to lift and unload, for instance a massive furniture (such as piano, etc.), through window opening.

OBJECT AND ADVANTAGES OF THE INVENTION

Accordingly, several objects and advantages of the present invention are to provide the lifting, loading and/or unloading of the objects.

It is another object of the invention to provide the possibility of the object lifting, loading and/or unloading through the openings/apertures in the limited space area between buildings, where the cranes can not be successfully used, It is still further object of the invention to reduce the time and expenses of the object lifting on the high level and loading and/or unloading into the closed space with the opening/aperture.

It is still another object of the invention to increase the safety and efficiency of the object lifting on the high level and loading and/or unloading into the closed space with the opening/aperture.

It is still another object of the invention to increase the safety and efficiency of the object lifting on the high level and loading/unloading into the closed space with the opening/aperture.

It is still further another object of the invention to reduce the time and expenses of the processes of the lifting device installation.

Still, further objects and advantages will become apparent from a consideration of the ensuing description accompanying drawings.

DESCRIPTION OF THE DRAWING

In order that the invention and the manner in which it is to be performed may be more clearly understood, embodiments thereof will be described by way of example with reference to the attached drawings, of which.

SUMMARY OF THE INVENTION

A portable lifting device provides the heavy and massive object lifting, loading and/or unloading through the window opening (wall openings). An improved portable lifting device includes a plurality of telescopic stanchions hingedly connected to the bases. Each of the telescopic stanchions comprises at least two of a plurality of telescopic sections. Also an improved portable lifting device comprises a frame connected by the adjustable holders to the stanchions, a girder with a trolley, a winch with an electrical motor, and a hook unit.

DESCRIPTION OF THE PREFERRED EMBODIMENTS

Here the description of an improved device will be done in statics (as if the components of the improved portable lifting device are suspended in the space) with description of their relative connections to each other. The description of the functional operations of an improved device will be done hereinafter.

Figure 1:
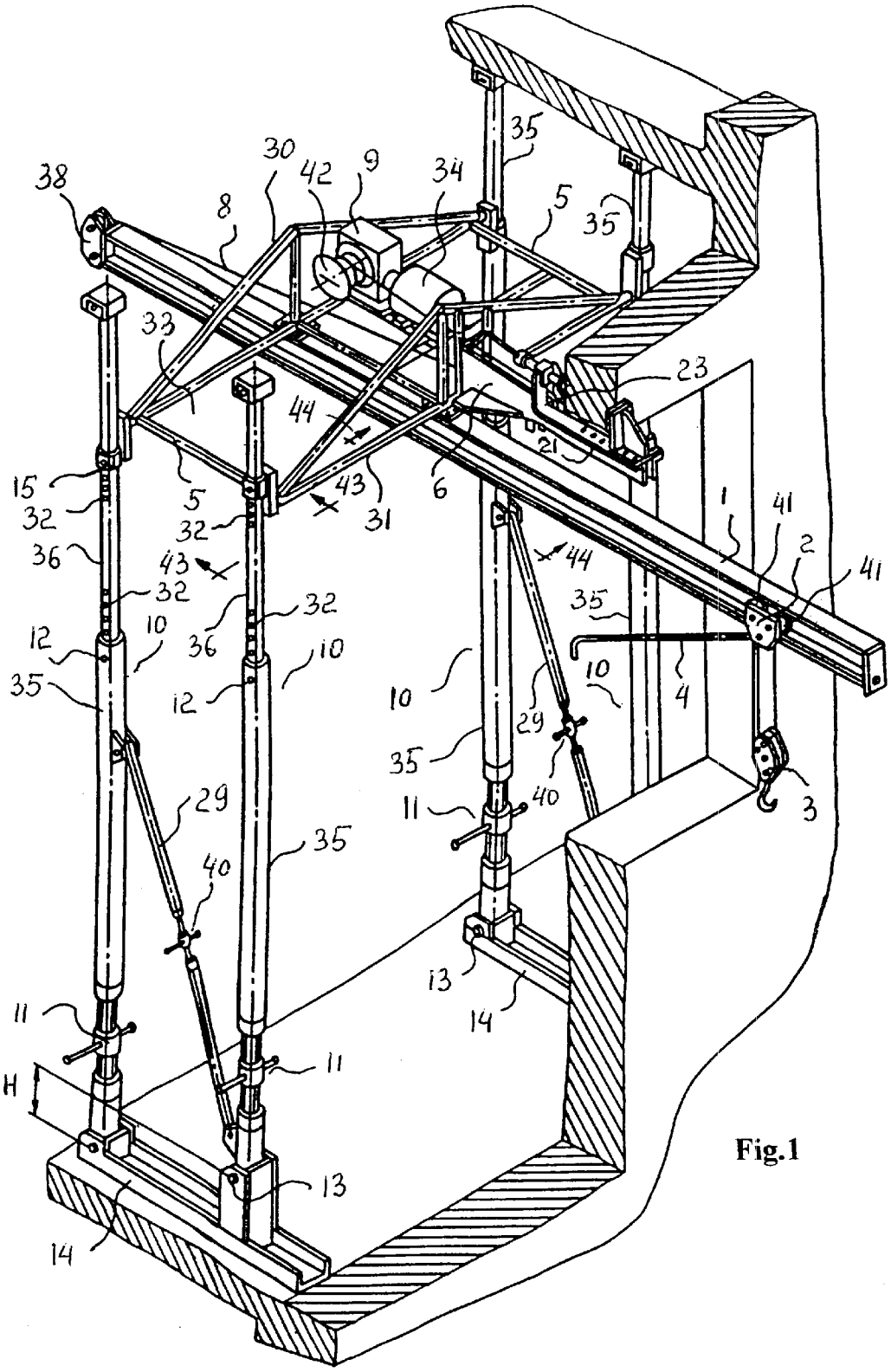
FIG. 1 is a simplified spatial representation of an improved portable lifting device.
Figure 2:
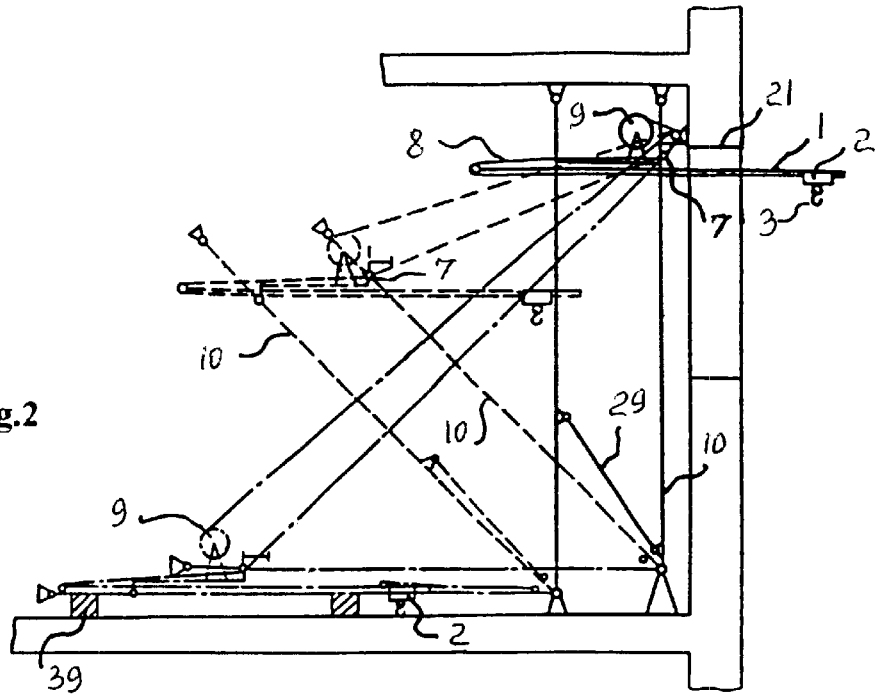
FIG. 2 is a simplified representation of an improved portable lifting device installation.
Figure 3A:
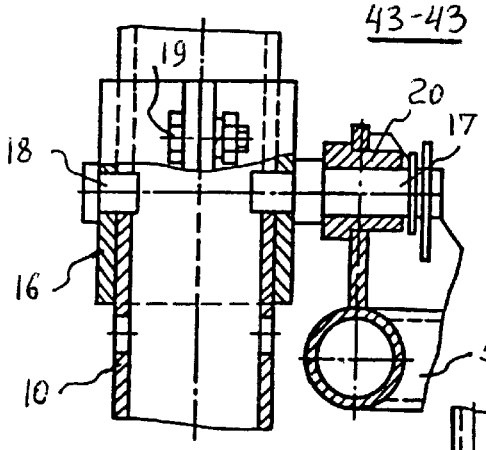
FIGS. 3*a*–3*c* are the simplified drawings of the cross-sectional views.

Referring to FIG. 1, an improved portable lifting device includes a trolley 2 installed in a girder (e.g. monorail, etc.) 1. The trolley 2 is coupled with a hook unit 3 and drum 42 of the winch 9 by a hoist cable (rope) 8. The girder 1 is by bolts (not shown) attached to the first triangular truss 30 and second triangular truss 31, which are respectively connected to the brackets 5. The brackets 5 and triangular trusses 30, 31 form the frame 33. The frame 33 is connected to the rest 6, which has a restrictive block 7 (see FIG. 2), using for the hoist cable 8 auxiliary passage at the time of the portable lifting device installation only. The electrically controlled winch 9, including an electrical motor 34, and a drum 42 with the cable 8, is installed on the frame 33. The frame 33 is connected to the telescopic stanchions 10, each of which has an adjustable screws 11. The improved portable lifting device can include a plurality of telescopic stanchions 10 (on FIG. 1 are shown, as an example, four telescopic stanchions). Each telescopic stanchion 10 can include a plurality of telescopic sections. (on FIG.1 are shown, as an example, two telescopic sections). The lower telescopic section 35 of each stanchion 10 has a main aperture 12 and the upper telescopic section 36 has the apertures 32. The height of each stanchion can be adjusted and fixed by the fixing fingers (not shown), passing through the main aperture 12 of the lower telescopic section 35 and appropriate aperture 32 of the upper telescopic section 36 of each stanchion 10 respectively. The lower telescopic section 35 of each telescopic stanchion 10 is by hinge 13 connected to the base 14. The extending struts 29 are used for the steady position of the stanchions 10. The height "H" is a difference between the appropriate stanchions 10 installation on the base 14 and provides a compact initial horizontal position of the lifting device, convenient for its mobility and size, as shown on FIG. 2. The frame 33 is by adjustable holders 15 connected to the stanchions 10. The connection is provided by the main pin 17 and pin 18. (see FIG. 3*a*), passing through the aperture in the holder 15 and an appropriate aperture 32 of the telescopic stanchion 10. Each holder 15 includes two semi-rings 16 connected to each other by the bolts 19 (see. FIG. 3*a*). As shown on FIG. 3*a,* the main pin 17 is through the bush 20 inserted into the aperture of the holder 15 and appropriate aperture 32. The bush 22 is connected to the bracket 5 of the frame 33.

Figure 3B:
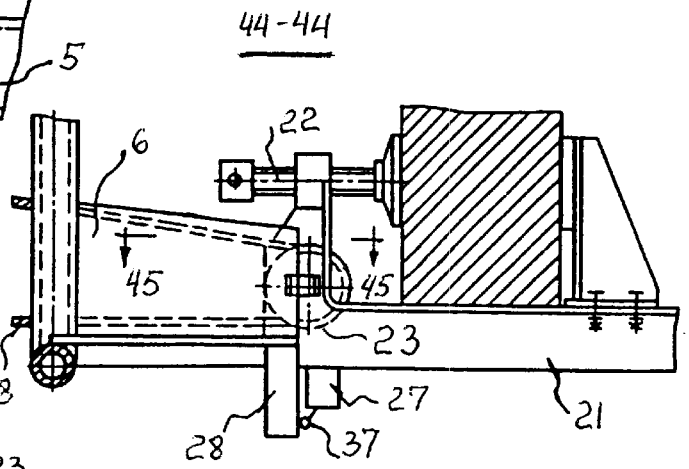

Referring to FIG. 3*b,* the grip 21 is by gripping screw 22 attached to the upper side of the window opening. The pulley 23 of the grip 21 is installed in the slots 24 in order to provide its mobility at the time of the lifting device installation.

Figure 3C:
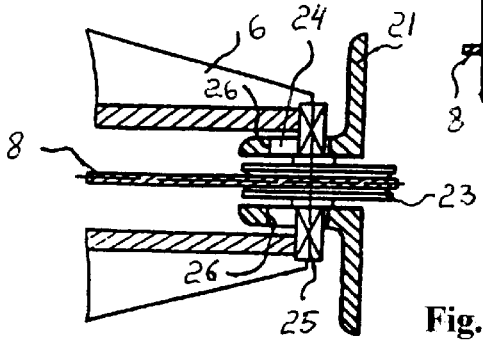

The improved portable lifting device operates as follows. At the time of the lifting device installation the axle 25 of the pulley 23 is rested to the slot edges 26 of the slots 24, as shown on FIG. 3*c*. On the grip 21 is installed the switch 27 (see FIG. 3*b*), providing the motor 34 of the winch 9 automatic turn-off at the moment of the contact of the switch lever 37 with the plate 28. The hoist cable 8 passes from the drum 42 of the winch 9 via pulley 23, restrictive block 7, girder block 38, block (not shown) of trolley 2 and pulley (not shown) of hook unit 3.

The portable lifting device is installed as follows. Initially, the telescopic stanchions 10 are not extended and in the horizontal position (for example, on the floor), as shown on FIG. 2 (the additional supports 39 can be used to prevent the damage of the stanchions 10).

The frame 33 with the winch 9 is attached to the girder 1, comprising the installed trolley 2. The stanchions 10 are by hinges 13 attached to the base 14. Then, the holders 15 are by auxiliary pin 18 and main pin 17 attached to the stanchions 10 (the main pin 17 is assembled with the bush 20 connected to the bracket 5 of the frame 33, thereby connecting the frame 33 with the girder 1 assembly to the stanchions 10). The main adjusting screws 11 are not initially extended. Then, the stanchions 10 are telescopically extended to the approximate length adequate to the a priori known floor-ceiling distance and fixed at this position by the fingers (not shown) through the main apertures 12 and appropriate apertures 32. The grip 21 is by griping screw 22 attached to the upper side of the window opening. The hoist cable 8 is from the drum 42 extended via pulley 23, restrictive block 7 girder block 38, block (not shown) of the trolley 2 and pulley (not shown) of the hook unit 3. Then, the motor 34 of the winch 9 is by the switch 27 turned-on, providing the stanchions 10 automatic uprise in the vertical position. When the stanchions 10 approach the final vertical position, the switch level 37 of the switch 27 is rested to the plate 28, turning-off the motor 34, thereby stopping the winch 9 operation and discontinuing uprise of the stanchions 10. The final adjustment of the stanchions 10 length is provided by the extension of the main adjusting screws 11, rigidly fixing the lifting device between floor and ceiling. The axle 25 of the pulley 23 is in the slot 26 shifted to the its final position for lifting operation, as shown on FIG. 3*c* (the final axle 25 position in the slot 26 is the position opposite to the slot edge 26). Finally, the extending struts 29 are installed and adjusted by the adjusting screws 40, and the lifting device is ready for lifting. The shifting of the trolley 2 in the girder 1 is easy provided by trolley rollers 41 and handle 4. The fixation of the trolley 2 in the girder 1 at the time of the lifting operation is provided by a handle 4 coupled, for example, with the rack and pinion or ratchet mechanisms (not shown) installed in the girder 1. The shifting of the lifted load through the window opening inside the building along girder 1 is provided by the same rack and pinion or ratchet mechanisms (the additional winch can be used too).

CONCLUSION, RAMIFICATION AND SCOPE

Accordingly the reader will see that, according to the inventions I have provided a portable lifting device for lifting, loading and/or unloading through the window opening. An improved portable lifting device has various possibilities.

While the above description contains many specificities, these should be not construed as limitations on the scope of the invention, but as exemplification of the presently-preferred embodiments thereof. Many other ramifications are possible within the teaching to the invention. For example, an improved portable lifting device provides simplification of the technological cycles of construction work, e.g. such as loading and/or unloading works, and provides an effective lifting, loading and/or unloading operations in the difficult-accessed areas, where the cranes can not be used. Also in some residential buildings, which are not provided with a cargo lift, an improved portable lifting device can be successful used for delivery of massive furniture (e.g. such as a piano) into residential unit.

Thus, the scope of the invention should be determined by the appended claims and their legal equivalents, and not by examples given.

What is claimed is:

1. A portable lifting device includes:

a plurality of telescopic stanchions, each of which is hingedly connected to an appropriate base and comprises a main adjusting screw, providing extension of a lower telescopic stanchion section;

a girder, comprising a girder block, and a trolley installed in said girder and including a handle providing shifting and fixation of said trolley along said girder;

a frame, including brackets and triangular trusses appropriately connected to each other, and wherein each bracket is rigidly connected to an appropriate bush, through which a main pin, passing through an aperture into a holder and an appropriate aperture into upper telescopic stanchion section of said appropriate telescopic stanchion, connects said frame to an appropriate telescopic stanchion;

a winch, comprising an electrical motor and a drum with a hoist cable, and wherein said winch includes a remote switch comprising a switch lever, which during an automatic installation of the assembled lifting device from an initial horizontal position to a vertical working position provides an automatic turn-off of said electrical motor at the moment of contact of said switch lever with a plate connected to a grip:

a grip, including a griping screw, a pulley on an axle, and wherein said axle is movable in a slot inside said grip, providing mobility of said pulley at the time of said automatic installation of the assembled lifting device from said initial horizontal position to said vertical working position;

a holder, coupling said each of said plurality of telescopic stanchions with said frame and comprising two semi-rings connected to each other;

a hook unit, including a hook pulley connected to a hook and coupled with said hoist cable, which is extended from said drum via said pulley, a restrictive block appropriately providing said automatic installation of the assembled lifting device from said initial horizontal position to said vertical working position, said girder block, a block of said trolley to said hook pulley of said hook unit.

* * * * *